United States Patent [19]

Schneider

[11] 3,936,725

[45] Feb. 3, 1976

[54] CURRENT MIRRORS

[75] Inventor: Herbert Anton Schneider, Boulder, Colo.

[73] Assignee: Bell Telephone Laboratories, Incorporated, Murray Hill, N.J.

[22] Filed: Aug. 15, 1974

[21] Appl. No.: 497,687

[52] U.S. Cl. ..... 323/1; 323/4; 323/9; 330/30 D

[51] Int. Cl.[2] ..... G05F 3/08

[58] Field of Search ..... 323/1, 4, 9; 330/19, 20, 330/22, 30 D

[56] References Cited

UNITED STATES PATENTS

| | | | |
|---|---|---|---|
| 3,629,692 | 12/1971 | Goyer | 323/4 |
| 3,835,410 | 9/1974 | Wittlinger | 330/19 |
| 3,838,262 | 9/1974 | van de Plassche | 330/30 D |
| 3,852,678 | 12/1974 | Frye | 330/22 |

OTHER PUBLICATIONS

*Electronics*, Apr. 28, 1969; pp. 139–140, (Vol. 42).

"Precision Voltage Source With High-Speed Polarity Control" by Hellwarth et al.; *IBM Tech. Disc. Bull.*, Vol. 15, No. 5, Oct. 1972; pp. 1590–1591.

"An Improved Multioutput Current-Controlled Source" by Schlotzhauer et al.; *Proc. IEEE* Aug. 1973, Vol. 61, No. 8, pp. 1154–1155.

"Improved Integrated Unity Gain Current-Controlled Sources" by Schlotzhauer et al.; *Int. J. Electronics*, Jan. 1974, Vol. 36, No. 1, pp. 97–100.

*Primary Examiner*—Gerald Goldberg

*Attorney, Agent, or Firm*—Ronald D. Slusky

[57] ABSTRACT

Improved current mirrors are provided by connecting current mirrors of known types in cascode.

7 Claims, 7 Drawing Figures

$$\left|I_{OUT} - I_{IN}\right| = \frac{2}{\beta+2}$$

$$\left|I_{OUT} - I_{IN}\right| = \frac{2}{\beta^4+2\beta^3+3\beta^2+2\beta+2}$$

NOTE: $B=\beta^4+2\beta^3+3\beta^2+2\beta+2$

CURRENT MIRRORS

BACKGROUND OF THE INVENTION

The present invention relates generally to controlled current sources, and in particular, to current mirrors.

A current source is an electrical element which provides an output current from a very high impedance. The output current magnitude is substantially independent of both the voltage impressed across the current source and the impedance presented thereto. In so-called "controlled" current sources, the magnitude of the output current, rather than being fixed, is a function of a control signal, for example, or a selected circuit parameter such as a resistor value.

A current mirror is a particular type of controlled current source in which the output current is controlled by an input current applied thereto. Current mirrors find use in numerous applications including operational amplifiers, line circuits and electronic switching. Current mirrors known in the art typically inlcude first and second base-coupled transistors. The input current is extended to the collector of the first base-coupled transistor and the output current is provided from the collector of the second base-coupled transistor. Base current for the two transistors is provided by circuitry which diverts a small amount of current away from the collector of one or the other of the transistors.

Ideally, the input and output currents of a unity-gain current mirror should have identical magnitudes. In practice, however, some input/output current deviation is always encountered. In some known current mirrors this deviation is as small as $2/\beta^2$ per unit of input current, $\beta$ being the common-emitter current gain of the transistors comprising the current mirror. In some applications, however, more precise input/output current matching may be required. Moreover, some applications may require a current mirror having higher output impedance than is typically provided by known arrangements.

SUMMARY OF THE INVENTION

Accordingly, a general object of the present invention is to provide improved controlled current sources.

A more specific object of the invention is to provide improved current mirrors which have very small input/output current deviation.

Another object of the invention is to provide improved current mirrors which have higher output impedances than are generally provided in the prior art.

These and other objects are achieved in accordance with the invention by connecting current mirrors of known types in cascode, the resulting structure being referred to herein as a "cascode current mirror".

More particularly, a cascode current mirror embodying the principles of the invention includes first and second current mirror stages of known types. A cascode connection is effected by coupling the emitter of each base-coupled transistor of the first stage to the collector of a respective one of the base-coupled transistors of the second stage. The emitters of the second stage transistors are connected to a source of potential. Input current is applied to the input terminal of the first stage; output current is provided at the output terminal thereof.

In accordance with a feature of the invention, the cascode connection may be made such that corresponding transistors of each current mirror stage are arranged on the same side of the cascode structure. In this arrangement, the emitters of the first and second transistors of the first stage are coupled to the collectors of the first and second transistors of the second stage, respectively. This "direct" cascode connection advantageously provides a current mirror having substantially higher output impedance than a single one of its constituent current mirror stages.

In accordance with a further feature of the invention, the cascode connection between the first and second current mirror stages may be made such that corresponding transistors of each stage are arranged on opposite sides of the cascode structure. In this arrangement, the emitters of the first and second transistors of the first stage are coupled to the collectors of the second and first transistors of the second stage, respectively. This "transposed" cascode connection advantageously provides a current mirror having substantially smaller input/output current deviation than either a single one of its constituent current mirror stages or two such stages connected in the above-described direct cascode configuration.

BRIEF DESCRIPTION OF THE DRAWING

The invention may be clearly understood from a consideration of the following detailed description and accompanying drawing in which.

DETAILED DESCRIPTION

Figure 1:
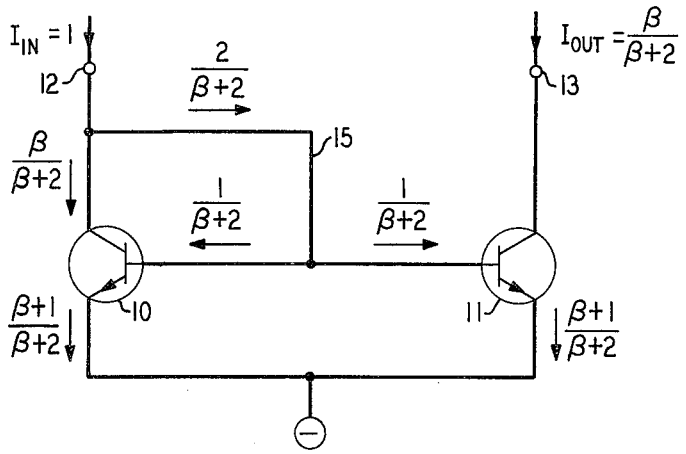
FIG. 1 (PRIOR ART)
FIG. 1 is a single-stage current mirror known in the art.

The single-stage current mirror shown in FIG. 1 is known in the art. It comprises input transistor 10 and output transistor 11, which are illustratively of the npn type. The emitters of transistors 10 and 11 are connected to a source of negative potential. Their bases are interconnected. Input current $I_{IN}$ is applied to terminal 12. Most of this current flows into the collector of transistor 10. A small amount thereof, however, is diverted via lead 15 to provide base current for transistors 10 and 11.

The various currents flowing in the current mirror of FIG. 1 are indicated in the drawing. It has been assumed that transistors 10 and 11 have equal common emitter current gain, $\beta$, and therefore equal collector currents inasmuch as their base-emitter voltages are constrained to be equal. In addition, the collector current of each transistor in the current mirror has been assumed to be $\beta$ times its base current. The magnitude of the resulting output current $I_{OUT}$ at terminal 13 is $\beta/\beta + 2$. Thus, the input/output current deviation, $|I_{out} - I_{in}|$, for the prior art current mirror of FIG. 1 is $2/\beta + 2$, which is approximately equal to $2/\beta$.

Figure 2:
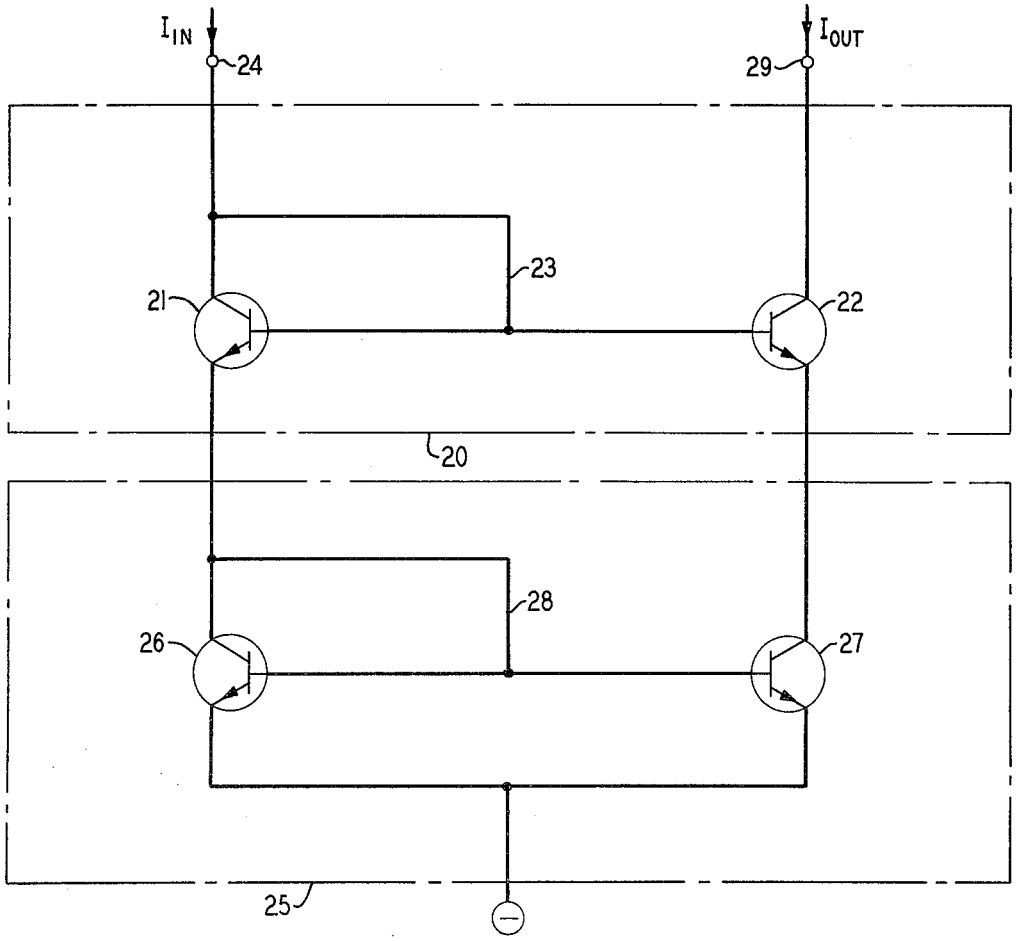
FIG. 2 is an illustrative cascode current mirror according to the invention comprising two current mirrors of the type shown in FIG. 1 connected in a direct cascode configuration.

Attention is now directed to FIG. 2, which shows a cascode current mirror according to the invention. The cascode current mirror of FIG. 2 comprises upper and lower current mirror stages 20 and 25, respectively, each illustratively of the known type shown in FIG. 1. Transistor 21 in current mirror 20 corresponds to transistor 26 in current mirror 25 since base currents in current mirrors 20 and 25 are provided by diverting a small amount of current away from the collectors of transistors 21 and 26 via leads 23 and 28, respectivly. Similarly, transistor 22 in current mirror 20 corresponds to transistor 27 in current mirror 25.

In accordance with the invention, current mirror stages 20 and 25 are connected in cascode; that is, the emitters of transistors 21 and 22 are each coupled to the collector of a respective one of transistors 26 and 27 rather than to a source of potential. In accordance with a feature of the invention, stages 20 and 25 are arranged in a direct cascode configuration whereby corresponding transistors of each stage are arranged on the same side of the cascode structure. Thus, the emitter of transistor 21 is coupled to the collector of transistor 26 on one side of the cascode structure and the emitter of transistor 22 is coupled to the collector of transistor 27 on the other.

The direct cascode current mirror of FIG. 2 provides somewhat larger input/output current deviation than the single-stage current mirror of FIG. 1. However, the former advantageously has substantially higher output impedance than the latter because the emitter impedance of output transistor 22 in FIG. 2 is substantially greater than the emitter impedance of output transistor 11 in FIG. 1. More particularly, the emitter impedance of output transistor 11 in FIG. 1 is substantially zero, while the emitter impedance of output transistor 22 in FIG. 2 is the impedance seen "looking into" the collector of transistor 27 — typically several tens or hundreds of kilohms.

Of course, the output impedance of a transistor is also determined by its base impedance; the smaller the base impedance, the larger the output impedance. The base impedance of output transistor 22 in FIG. 2 is somewhat larger than the base impedance of output transistor 11 in FIG. 1. However overall, a substantial increase in output impedance is provided by the cascode current mirror of FIG. 2 over the single-stage current mirror of FIG. 1.

Figure 3:
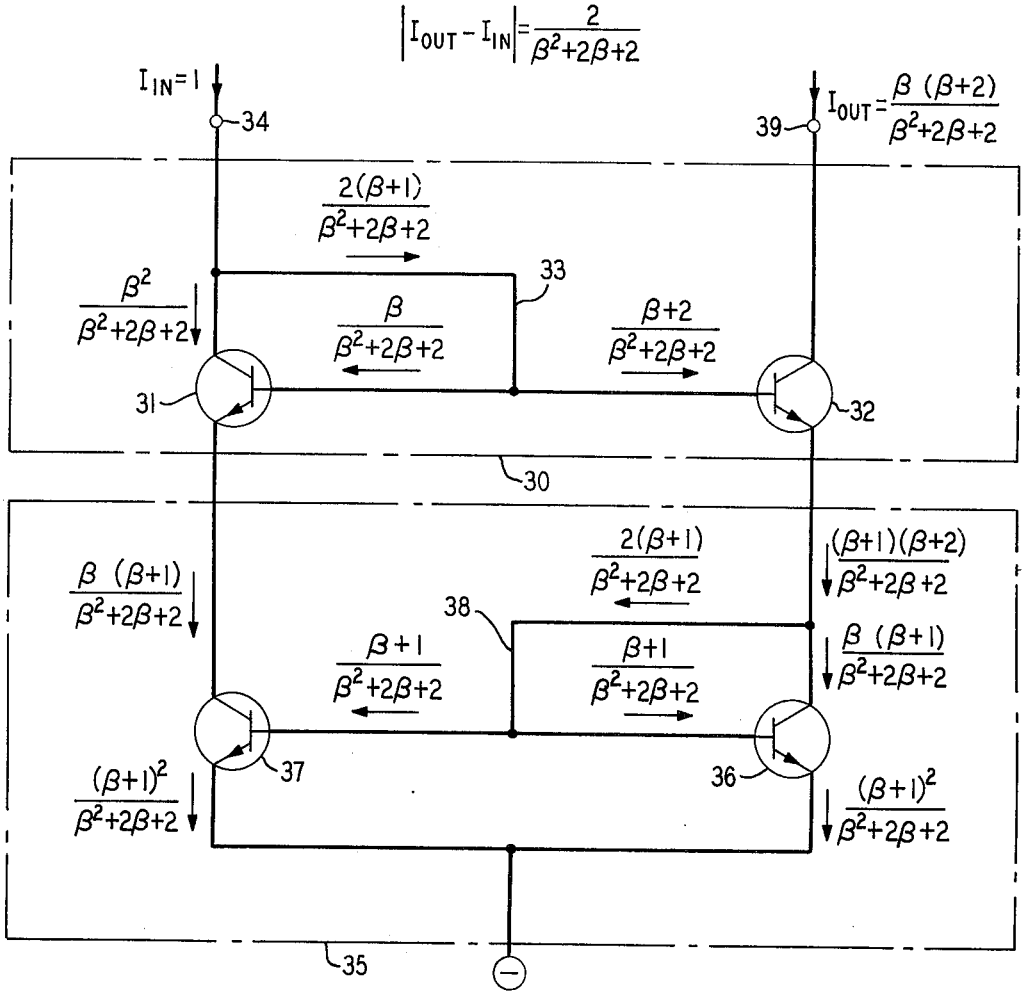
FIG. 3 is an illustrative cascode current mirror according to the invention comprising two current mirrors of the type shown in FIG. 1 connected in a transposed cascode configuration.

As in FIG. 2, the cascode current mirror of FIG. 3 comprises two current mirror stages, each illustratively of the known type shown in FIG. 1. However in FIG. 3, the upper and lower current mirror stages are arranged in a "transposed" cascode configuration in which corresponding transistors of each stage are arranged on opposite sides of the cascode structure. Computer analysis of the transposed cascode current mirror of FIG. 3 has indicated that its output impedance is, advantageously, substantially higher than that of the direct cascode configuration of FIG. 2. Additionally, in accordance with a feature of the invention, the transposed cascode configuration of FIG. 3 advantageously provides substantially smaller input/output current deviation than either the single-stage current mirror of FIG. 1 or the direct cascode current mirror of FIG. 2.

In particular, the cascode current mirror of FIG. 3 comprises upper and lower current mirror stages 30 and 35. Transistor 31 in current mirror 30 corresponds to transistor 36 in current mirror 35 while transistor 32 in current mirror 30 corresponds to transistor 37 in current mirror 35. The transposed cascode connection between stages 30 and 35 is effected by coupling the emitter of transistor 31 to the collector of transistor 37 on one side of the cascode structure and the emitter of transistor 32 to the collector of transistor 36 on the other side of the cascode structure.

Input current $I_{IN}$ applied to terminal 34 illustratively has unity magnitude. The resulting output current $I_{OUT}$ at terminal 39 has a magnitude $$\beta(\beta + 2)/\beta^2 + 2\beta + 2.$$

Accordingly, the input/output current deviation for the cascode current mirror of FIG. 3 is $$2/\beta^2 + 2\beta + 2,$$

which is substantially equal to $2/\beta^2$. Cascoding two current mirror stages of the know type shown in FIG. 1 in the transposed cascode configuration of FIG. 3 is thus seen to advantageously provide a factor-of-$\beta$ improvement in input/output current deviation over a single such stage.

The currents in the cascode current mirror of FIG. 3 have been computed assuming that the $\beta$'s of transistors 31, 32, 36 and 37 are identical. However, even if the $\beta$'s are somewhat mismatched, the cascode current mirror of FIG. 3 still provides significant improvement in input/output current deviation over the prior art current mirror of FIG. 1.

Figure 4:
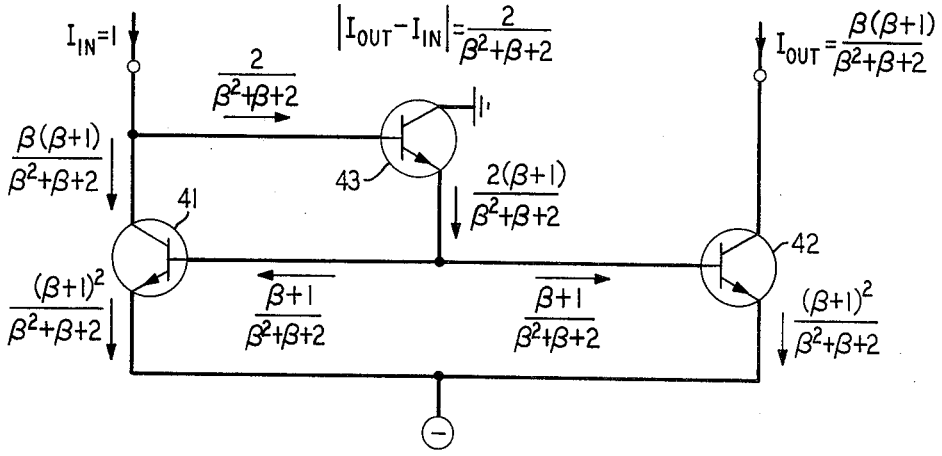
FIG. 4 (PRIOR ART)
FIG. 4 is another single-stage current mirror known in the art.

Another single-stage current mirror known in the art is shown in FIG. 4. This current mirror comprises base-coupled transistors 41 and 42 and "helper" transistor 43. The input/output current deviation for the current mirror of FIG. 4 is $$2/\beta^2 + \beta + 2 \approx 2/\beta^2.$$

Figure 5:
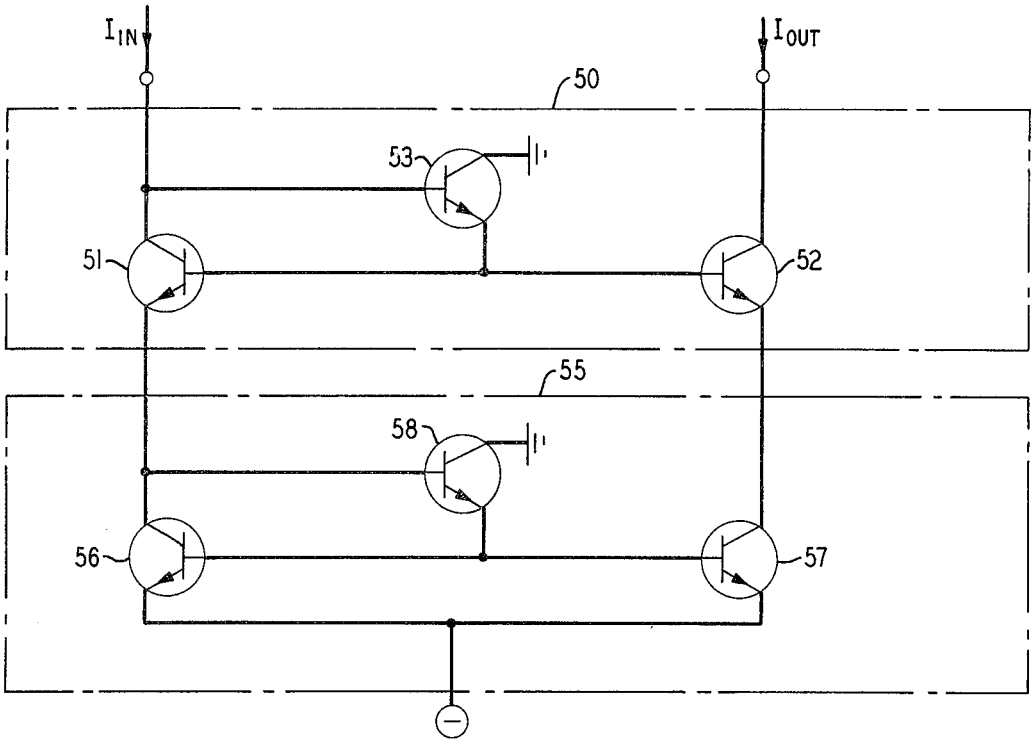
FIG. 5 is an illustrative cascode current mirror according to the invention comprising two current mirrors of the type shown in FIG. 4 connected in a direct cascode configuration.

FIG. 5 shows a cascode current mirror according to the invention. The cascode current mirror of FIG. 5 comprises upper and lower current mirror stages 50 and 55, respectively, each of the known type shown in FIG. 4. Current mirror stage 50 includes transistors 51, 52 and 53. Current mirror stage 55 includes transistors 56, 57 and 58. As in the illustrative embodiment of FIG. 2, the current mirror stages in FIG. 5 are arranged in a direct cascode configuration with corresponding transistors of each stage arranged on the same side of the cascode structure.

The base impedance of output transistor 52 in FIG. 5 is somewhat larger than the base impedance of output transistor 42 in FIG. 4. However, the substantially greater emitter impedance of transistor 52 as compared to that of transistor 42 provides the cascode current mirror of FIG. 5 with substantially higher output impedance than the single-stage current mirror of FIG. 4.

Figure 6:
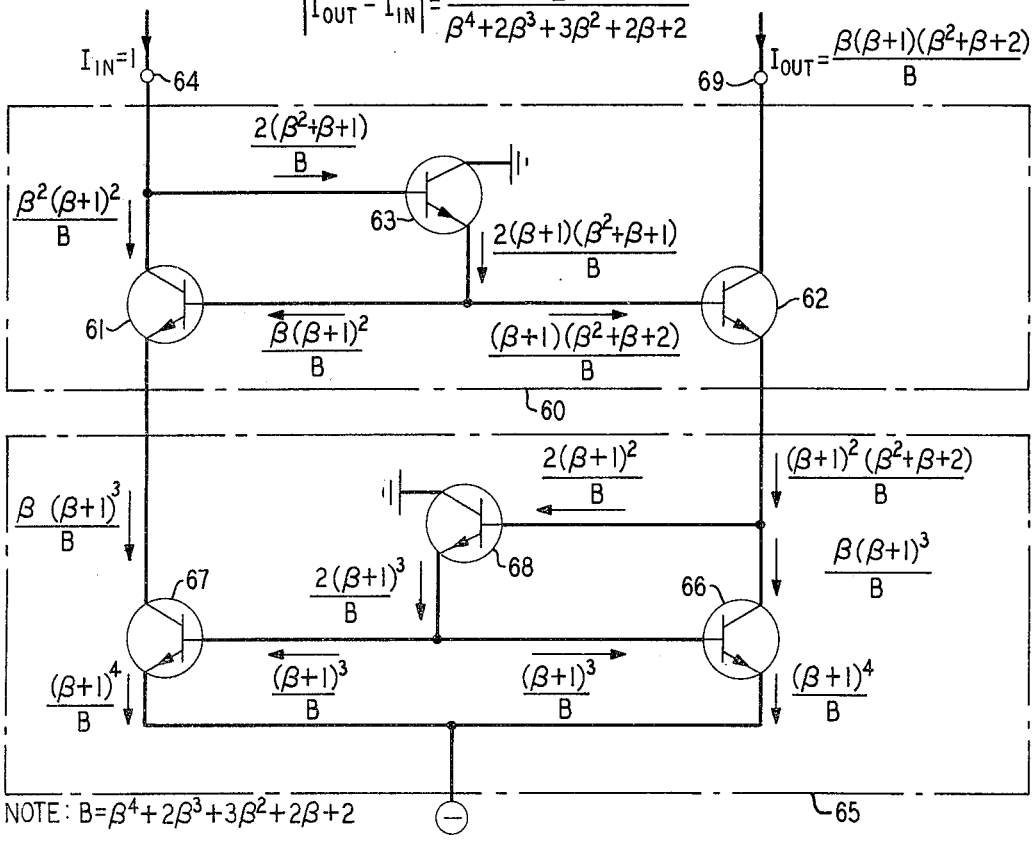
FIG. 6 is an illustrative cascode current mirror according to the invention comprising two current mirrors of the type shown in FIG. 4 connected in a transposed cascode configuration.

As in FIG. 5, the cascode current mirror of FIG. 6 comprises two current mirror stages each illustratively of the known type shown in FIG. 4. However in FIG. 6, the upper and lower current mirror stages are arranged in a transposed cascode configuration in which corresponding transistors of each stage are arranged on opposite sides of the cascode structure. Computer analysis of the transposed cascode current mirror of FIG. 6 has indicated that its output impedance is approximately the same as that of the direct cascode configuration of FIG. 5. Advantageously, in accordance with a feature of the invention, the transposed cascode configuration of FIG. 6 provides substanially smaller input- /output current deviation than either the single-stage current mirror of FIG. 4 or the "direct" cascode current mirror of FIG. 5.

In particular, the cascode current mirror of FIG. 6 comprises upper and lower current mirror stages 60 and 65. Transistor 61 in current mirror 60 corresponds to transistor 66 in current mirror 65 while transistor 62 in current mirror 60 corresponds to transistor 67 in current mirror 65. The transposed cascode connection between stages 60 and 65 is effected by coupling the emitter of transistor 61 to the collector of transistor 67 on one side of the cascode structure and the emitter of transistor 62 to the collector of transistor 66 on the other side of the cascode structure.

Input current $I_{IN}$ applied to terminal 64 illustratively has unity magnitude. The resultant output current $I_{OUT}$ at terminal 69 has a magnitude $$\beta(\beta+1)\ (\beta^2+\beta+2)/\beta^4 + 2\beta^3 + {}^3\beta^2 + 2\beta + 2.$$

In FIG. 6, the denominator of this fraction has been indicated as "B" due to space limitations. The input-/output current deviation for the cascode current mirror of FIG. 6 is thus seen to be $$2/\beta^4 + 2\beta^3 + 3\beta^2 + 2\beta + 2 \approx 2/\beta^4.$$

Cascoding two current mirror stages of the known type shown in FIG. 4 in the transposed cascode configuration of FIG. 6 is thus seen to advantageously provide a factor-of-$\beta^2$ improvement in input/output current deviation over a single such stage.

The cascode current mirrors thus far described herein all have unity gain. However, in some applications, it may be required to have a current mirror in which the output current is equal to some predetermined multiple or fraction of the input current. Advantageously, the cascode current mirrors of the present invention such as those in FIGS. 2, 3, 5 and 6 may be modified to provide such non-unity gain. The modification is effected by substituting M parallelly connected transistors for each of the transistors on the input side of the cascode current mirror and by further substituting N parallelly connected transistors for each of the transistors on the output side of the cascode current mirror. M and N may each be any integer including "1". The output current of the cascode current mirror so modified is then given by N/M times its input current.

Figure 7:
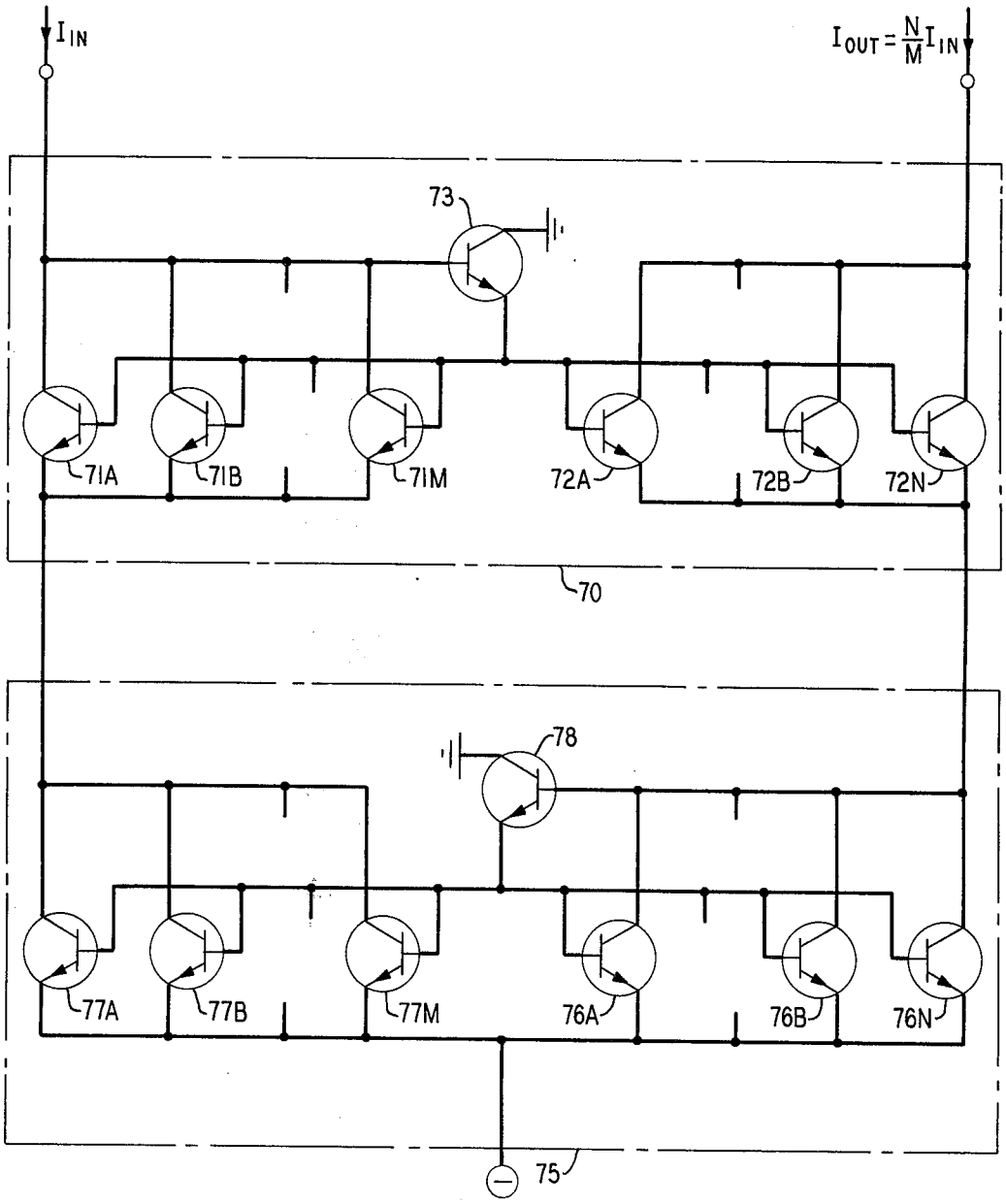
FIG. 7 is an illustrative cascode current mirror according to the invention which provides other-than-unity gain.

Reference may be made to the cascode current mirror of FIG. 7 which comprises upper and lower stages 70 and 75. The cascode current mirror of FIG. 7 is illustratively of the general type shown in FIG. 6. However, stage 70 in FIG. 7 includes M parallelly connected transistors 71A, 71B...71M on the input side of the cascode structure and N parallelly connected transistors 72A, 72B...72N on the output side. Similarly, stage 75 includes M parallelly connected transistors 77A, 77B...77M on the input side of the cascode structure and N parallelly connected transistors 76A, 76B...76M on the output side. Stages 70 and 75 further respectively include helper transistors 73 and 78. As indicated in the drawing, the output current $I_{OUT}$ of the cascode current mirror of FIG. 7 is given by N/M times its input current, $I_{IN}$.

Although specific embodiments of cascode current mirrors are shown and described herein, it is anticipated that improvement in output impedance, input-/output current deviation and other current mirror characteristics may be obtained by cascoding other current mirrors which are known or which may become known in the art. These may include, for example, the current mirrors shown in G. R. Wilson, "A Monolithic Junction FET-NPN Operational Amplifier," *Proceedings of the International Solid-State Circuits Conference,* page 21, Feb. 1968, and G. I. Bredenkamp, "A Precision Current Multiplier Divider," *Proceedings of the IEEE,* Vol. 60, page 1441, Nov. 1972. It is also anticipated that improved current mirrors can be provided by cascoding two current mirrors each of which is itself a cascode current mirror embodying the principles of the present invention.

Thus it will be appreciated that many and varied arrangements embodying the principles of the invention may be devised by those skilled in the art without departing from the spirit and scope thereof.

I claim:

1. In combination, a first current mirror and a second current mirror, each of said current mirrors comprising first and second transistors, means for interconnecting the bases of said first and second transistors and means connected to the collector of said first transistor for providing base current for said first and second transistors, and cascode means for connecting said first and second current mirrors in a cascode configuration, said cascode means comprising means for coupling the emitter of each of said first and second transistors of said first current mirror to the collector of a respective one of said first and second transistors of said second current mirror.

2. The combination of claim 1 wherein said emitter coupling means comprises means for coupling the emitters of said first and second transistors of said first current mirror to the collectors of said second and first transistors of said second current mirror, respectively, and wherein said combination further includes means for applying an input current to the collector of said first transistor of said first current mirror.

3. The combination of claim 2 wherein said base current providing means of each of said current mirrors comprises a third transistor, means for connecting the base of said third transistor to the collector of said first transistor, and means for connecting the emitter of said third transistor to the bases of said first and second transistors.

4. The combination of claim 1 wherein each of said current mirrors further comprises at least a third transistor connected in parallel to a selected one of said first and second transistors.

5. In combination, a first current mirror comprising first and second transistors, means for interconnecting the bases of said first and second transistors, first base current means for connecting the bases of said first and second transistors to the collector of a selected one of said first and second transistors; a second current mirror comprising third and fourth transistors, means for interconnecting the bases of said third and fourth transistors, and second base current means for connecting the bases of said third and fourth transistors to the collector of a selected one of said third and fourth transistors; means for connecting the emitters of said third and fourth transistors to a source of potential; means for coupling the emitters of said first and second transistors to the collectors of said third and fourth transistors, respectively; and means connected to the collector of said first transistor for receiving an input current, whereby an output current substantially equal to said input current is provided at the collector of said second transistor.

6. The combination of claim 5 wherein said first base current means comprises means for connecting the bases of said first and second transistors to the collector of said first transistor and wherein said second base current means comprises means for connecting the bases of said third and fourth transistors to the collector of said fourth transistor.

7. The combination of claim 6 wherein said first base current means includes a fifth transistor, means for connecting the base of said fifth transistor to the collector of said first transistor, and means for connecting the emitter of said fifth transistor to the bases of said first and second transistors, and wherein said second base current means includes a sixth transistor, means for connecting the base of said sixth transistor to the collector of said fourth transistor, and means for connecting the emitter of said sixth transistor to the bases of said third and fourth transistors.

* * * * *

UNITED STATES PATENT AND TRADEMARK OFFICE

CERTIFICATE OF CORRECTION

PATENT NO. : 3,936,725

DATED : February 3, 1976

INVENTOR(S) : Herbert A. Schneider

It is certified that error appears in the above-identified patent and that said Letters Patent are hereby corrected as shown below:

Column 3, line 3, delete "$\beta/\beta$"; line 4, delete "+ 2" and insert therefor -- $\frac{\beta}{\beta + 2}$ --; line 5, delete "$2/\beta$ +"; line 6, delete "2" and insert therefor -- $\frac{2}{\beta + 2}$ --. Column 4, line 17 should read -- $\frac{\beta(\beta + 2)}{\beta^2 + 2\beta + 2}$.--; line 20 should read -- $\frac{2}{\beta^2 + 2\beta + 2}$ --; line 39 should read -- $\frac{2}{\beta^2 + \beta + 2} \approx 2/\beta^2$.--. Column 5, line 18 should read -- $\frac{\beta(\beta+1) \quad (\beta^2+\beta+2)}{\beta^4 + 2\beta^3 + 3\beta^2 + 2\beta + 2}$ --; line 23 should read -- $\frac{2}{\beta^4 + 2\beta^3 + 3\beta^2 + 2\beta + 2} \approx 2/\beta^4$. --.

Signed and Sealed this

Fourth Day of January 1977

[SEAL]

*Attest:*

RUTH C. MASON
*Attesting Officer*

C. MARSHALL DANN
*Commissioner of Patents and Trademarks*